United States Patent [19]

Burke

[11] 4,202,309

[45] May 13, 1980

[54] AUTOMATIC STARTING FLUID DISPENSER

[76] Inventor: James W. Burke, Rte. 2, Box 476, Long Grove, Ill. 60047

[21] Appl. No.: 926,413

[22] Filed: Jul. 20, 1978

[51] Int. Cl.[2] ..... F02M 1/16
[52] U.S. Cl. ..... 123/180 R; 123/180 AC
[58] Field of Search ..... 123/180 R, 180 AL, 187.5 R

[56] References Cited

U.S. PATENT DOCUMENTS

| | | | |
|---|---|---|---|
| 2,287,900 | 6/1942 | Parker | 123/187.5 R |
| 2,469,751 | 5/1949 | Sweeny | 123/187.5 R |
| 2,704,536 | 3/1955 | Edwards | 123/187.5 R |
| 2,943,766 | 7/1960 | Orr | 123/180 R |
| 2,945,483 | 7/1960 | Howell | 123/179 |
| 3,055,750 | 9/1962 | DeCarolis | 123/180 R |
| 3,189,014 | 6/1965 | Kus | 123/187.5 R |
| 3,190,277 | 6/1965 | Tessier | 123/187.5 R |
| 3,198,404 | 8/1965 | Welches | 222/394 |
| 3,297,011 | 1/1967 | Gray | 123/180 R |
| 3,416,507 | 12/1968 | Little | 123/180 R |
| 3,448,733 | 6/1969 | Ashe | 123/180 R |
| 3,960,131 | 6/1976 | Davis | 123/180 R |

OTHER PUBLICATIONS

*Using Ether Systems for Cold Weather Starting*, Esbrook, Diesel and Gas Turbine Progress, 1973.

*Primary Examiner*—Ronald H. Lazarus
*Assistant Examiner*—P. S. Lall
*Attorney, Agent, or Firm*—Hume, Clement, Brinks, Willian & Olds Ltd.

[57] ABSTRACT

An automatic dispenser for injecting starting fluid into an internal combustion engine is disclosed. This dispenser includes a valve actuator which is adapted to receive a valved cannister containing a pressurized starting fluid and to pass starting fluid from the cannister through a conduit to an injector positioned in an air intake passage of the engine. The valve actuator is coupled to the starting system of the engine so that the cannister valve is automatically actuated and starting fluid is continuously injected into the engine during operation of the engine's starter motor. In this way a continuous flow of starting fluid is automatically dispensed during engine cranking. The valve actuator is also provided with a reservoir which temporarily stores a predetermined volume of starting fluid while fluid is flowing through the actuator, and then supplies this fluid to the injector after the cranking has stopped, thereby providing starting fluid to the engine during the period immediately following termination of cranking.

19 Claims, 7 Drawing Figures

FIG. 1
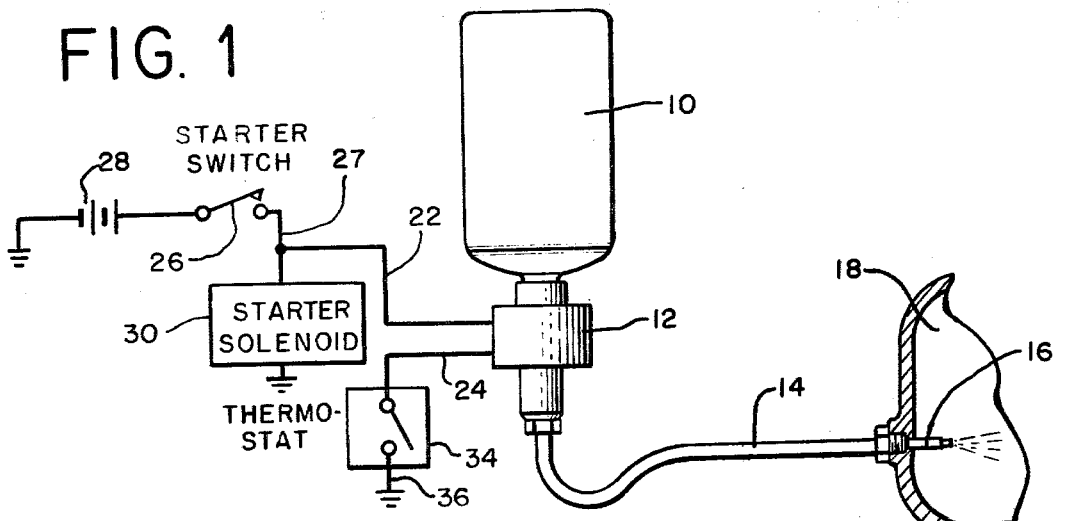
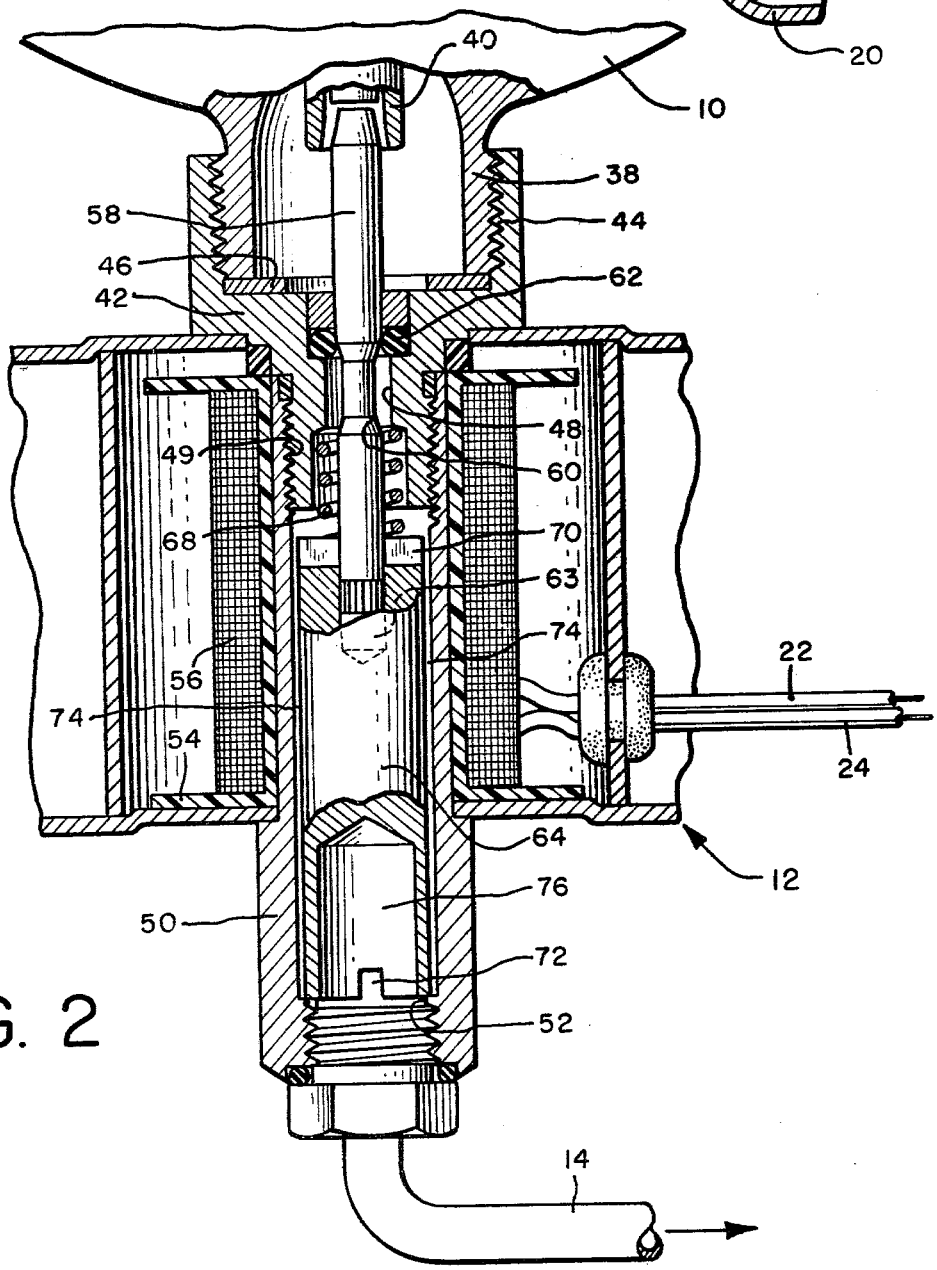
FIG. 2

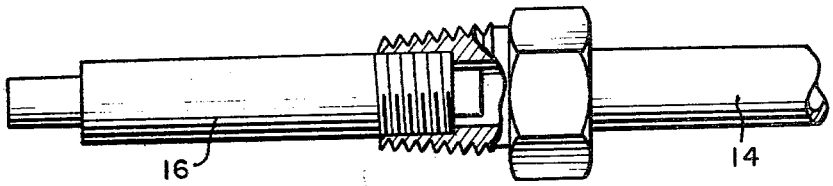
FIG. 3
FIG. 4a
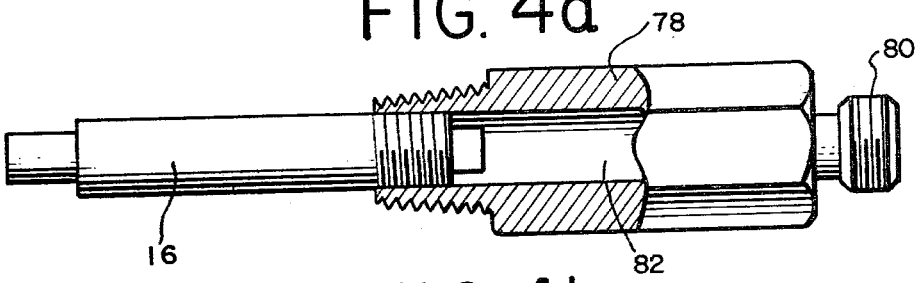
FIG. 4b
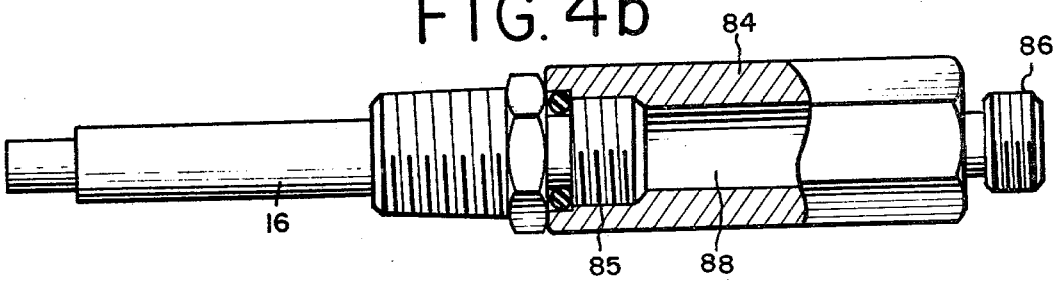
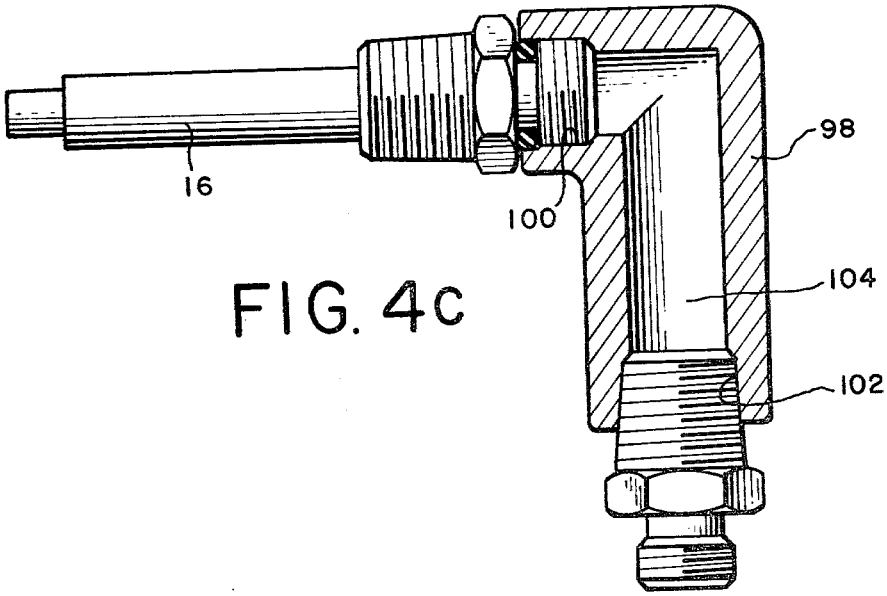
FIG. 4c
FIG. 4d
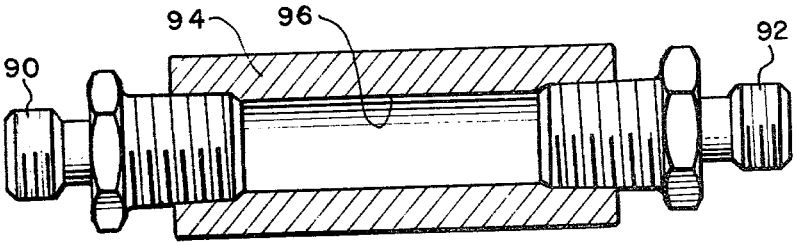

AUTOMATIC STARTING FLUID DISPENSER

BACKGROUND OF THE INVENTION

Internal combustion engines, particularly diesel engines, are plagued by cold starting problems. One effective method of improving cold starting is to inject a starting fluid such as an ether based fuel into the engine during cranking. The present invention is directed to an improved dispenser for automatically injecting starting fluid during engine startup without operator intervention.

In the past, several types of starting fluid dispensers have been used in connection with starting fluid injection. Originally, dispensers were manually controlled by the operator. Such dispensers have several disadvantages. Since they rely on operator activation, these dispensers inject a highly variable amount of starting fluid into the engine. For example, the operator can fail to operate the dispenser or can operate it improperly, thereby injecting inadequate starting fluid for prompt starting. Furthermore, the timing of the injection of starting fluid into the engine can be important, and the timing of a manually operated dispenser is no more consistent than the operator. Moreover, such dispensers can be abused by the operator to inject starting fluid into the engine when running for a momentary increase in power. This practice, known as "ether jockeying" can result in engine damage.

In response to these disadvantages of manually operated dispensers, Davis in U.S. Pat. No. 3,960,131, disclosed an automatic engine starting system which automatically dispenses starting fluid in a series of pulses during engine cranking. The Davis system employs a measured shot valve which dispenses a measured volume of fluid with each cycle. The valve is automatically driven to repeatedly dispense measured volumes of starting fluid during engine cranking.

The Davis device suffers from the important disadvantages that it is a pulsed flow system. It has been discovered that the pulsed flow produced by the measured shot valve results in a wide range of fluid pressure at the point of injection into the engine. This variation in pressure results in a varying injection rate and efficiency of atomization; both of which are thought to adversely effect the uniformity of delivery of starting fluid to the engine.

Furthermore, the measured shot approach of Davis results in erratic delivery of starting fluid to the engine following termination of cranking. After cranking stops, the volume of fluid remaining in the valve is dispensed to the engine. However, this volume can vary widely, depending on the point in the valve cycle at which cranking stops. For example, if cranking stops near the end of the filling of the measured volume, then almost an entire measured shot of fluid will be dispensed following cranking. On the other hand, if cranking stops near the beginning of the filling of the measured volume, a much smaller amount of fluid will be dispensed.

Moreover, a measured shot valve such as used by Davis is relatively complex. The valve itself is often more expensive to produce than continuous flow valves, and the valve control mechanism must include means for cycling the valve. Thus, the Davis approach is relatively expensive to produce as well as erratic in operation.

SUMMARY OF THE INVENTION

The present invention is directed to an improved automatic starting fluid dispenser which dispenses starting fluid from a pressurized storage cannister to an injector mounted in an air intake passage of an internal combustion engine. The dispenser includes a valve actuator which is coupled to the starter means of the engine so that starting fluid is continuously dispensed to the injector during operation of the engine starter means. The dispenser also includes a reservoir in fluid communication with the injector which is filled when starting fluid is being dispensed. Then, when cranking stops and starting fluid is no longer being dispensed from the cannister, the fluid in the reservoir flows to the injector, causing starting fluid to be injected into the engine for a period immediately after cranking has stopped. This post cranking injection of starting fluid serves to reduce engine faltering after the initial startup and to promote prompt starting.

The present invention continuously dispenses starting fluid during engine cranking. The flow of starting fluid is not interrupted into a series of pulses, and fluid pressure at the injector is, therefore, higher and more nearly constant than in automatic dispensers of the type shown by Davis. This is thought to improve both atomization and distribution of the injected starting fluid.

Furthermore, since the fluid flow is not pulsed, the amount of starting fluid dispensed after cranking has stopped is more nearly constant. Post cranking injection is important in cold starting, because an engine will often falter and die after it initially fires and cranking stops. By injecting a predetermined volume of starting fluid after cranking has stopped, cold starting is facilitated.

The dispenser of the present invention is a relatively simple, reliable apparatus which can be fabricated at low cost and does not require cycling devices. The invention, together with further objects and attendant advantages, will be best understood by reference to the following description taken in connection with the accompanying drawings.

BRIEF DESCRIPTION OF THE DRAWINGS

FIG. 1 is a schematic representation of a preferred embodiment of the automatic starting fluid dispenser of this invention.

FIG. 2 is a cross-sectional view of the valve actuator of the embodiment of FIG. 1.

FIG. 3 is a detailed view in partial cutaway of the injector of FIG. 1.

FIGS. *4a* to *4d* are detailed views in partial cutaway of alternate embodiments of the starting fluid reservoir.

DETAILED DESCRIPTION OF PREFERRED EMBODIMENTS

Referring now to the drawings, FIG. 1 is a schematic representation of an automatic starting fluid dispensing apparatus embodying the present invention. A valved cannister 10 containing a pressurized starting fluid such as an ether based fuel is connected to an automatic valve actuator 12 which operates to dispense fluid into a conduit 14. An injector 16 is mounted on a surface 20 of an air intake passage 18 of an internal combustion engine. Fluid dispensed by the valve actuator 12 passes through a restricting orifice (not shown) in the injector 16 and is atomized in the intake air of the engine. This atomized starting fluid is then carried to the combustion chambers of the engine where it promotes ignition and facilitates engine startup.

The valve actuator 12 is electrically operated and will be described in detail below in connection with FIG. 2. However, it should be mentioned here that the valve actuator 12 has two electrical leads 22,24 which carry current that activates the valve actuator 12. Electrical lead 22 is connected to the starter solenoid control lead 27 of the starter solenoid 30. This connection can be made either in the engine compartment or the passenger compartment, wherever installation is convenient. For example, in many applications the starter solenoid control lead 27 is readily accessible at the starter solenoid in the engine compartment or at the starter switch in the passenger compartment.

The starter solenoid 30 acts to switch large currents to the starter motor (not shown) when voltage is applied to the lead 27. The lead 27 is connected by a starter switch 26 to a battery 28. In the arrangement shown, the switch 26 is closed to energize the solenoid 30 and thereby to initiate engine cranking. A portion of the current on lead 27 is tapped off through lead 22 to energize the valve actuator 12 only when the engine is being cranked. In some applications other starting means are used for engine cranking instead of the arrangement shown, and in these cases the lead 22 should be appropriately coupled to the starter means such that the valve actuator 12 is energized when the engine is being cranked.

Electrical lead 24 is connected via a thermostatic switch 34 to ground. This temperature sensitive switch 34 is preferably mounted on the engine to monitor engine temperature. The switch 34 closes when engine temperature is lower than a preselected value. The switching temperatures should be chosen to suit the particular engine so that electrical lead 24 is interrupted whenever engine temperature is high enough that no starting fluid injection is required for prompt engine startup. In practice, a switching temperature of about 50° F. has been found suitable for a number of diesel engines. The switch 34 can be chosen to respond to coolant temperature, head temperature, or any other indicator of engine temperature.

Referring now to FIG. 2, the automatic valve actuator 12 is an electrically operated solenoid actuator. The actuator 12 includes a stator 42 which defines internal threads 44. Conventional starter fluid cannisters are provided with a threaded neck member 38 surrounding a valve 40. When the cannister 10 is threaded into the stator 42 as shown, the neck member 38 is brought adjacent the stator 42, and a fluid tight seal is formed between the neck member 38 and the stator 42 by the gasket 46.

The stator 42 defines a centrally positioned intake bore 48 extending through the stator as shown. A tubular member 50 is secured to the rear portion 49 of the stator 42 in a substantially fluid tight manner. An exit bore 52 is formed in the tubular member 50 opposite the stator 42. This exit bore is in fluid communication with the conduit 14. Surroundng the tubular member 50 is a bobbin 54 on which is wound an electrical coil 56. Electrical leads 22, 24 are connected to the terminals of the coil 56.

A movable armature 64 is positioned inside the tubular member 50 and is provided with grooves 70,72 along each end surface. A cavity 76 is formed in the end of the armature 64 adjacent the exit bore 52, and a drive rod 58 is press fit into a recess 63 formed in the end of the armature 64 adjacent the stator 42. A spring 68 is provided between the armature 64 and the stator 42 to damp the motion of the armature and to reduce vibration.

The drive rod 58 passes through the intake bore 48 to a point adjacent the cannister valve 40. A groove 60 extends around the perimeter of the drive rod, and an O-ring type seal 62 is positioned adjacent the intake bore 48 near the groove 60. The seal is so positioned that when the armature 64 and drive rod 58 are positioned as shown in FIG. 2, a substantially fluid tight seal is formed between the stator 42 and the drive rod 58. In this position the seal 62 acts as a backup to the cannister valve 40. Thus, if the cannister valve 40 fails during use, the O-ring seal 62 prevents the cannister from discharging through the valve actuator 12 into the engine. However, the seal 62 does not restrict the flow of starting fluid through the valve actuator 12 when the coil is energized, for then the armature moves toward the valve stator 42. This movement simultaneously opens the cannister valve 40 and moves the groove 60 adjacent the seal 62. In this position, the seal 62 does not contact the drive rod 58, and starting fluid can pass between the seal 62 and the drive rod 58 into the interior of the valve actuator 12.

In operation, the dispensing apparatus of this embodiment provides an automatic starting fluid injecton system that operates without any intervention by the operator. When the operator closes the starter switch 26 to initiate engine cranking, current is passed from the battery 28 through the switch 26, the leads 27,22 to the coil 56. If engine temperature is so low as to close the temperature sensitive switch 34, then the coil 56 will be energized, thereby advancing the armature 64 toward the stator 42 and opening the cannister valve 40. Starting fluid then flows from the cannister 10, through the intake bore 48, through the groove 70 into the interior of the valve actuator 12. The fluid then passes around the armature 64 to the exit bore 52, where it fills the reservoir 76 and passes out through the conduit 14 to the injector 16 for atomization in the air intake passage.

The actuator 12 is controlled to maintain the valve 40 in the open position until engine cranking is terminated or engine temperature rises above the switching temperature of the thermostat switch 34. During this period starting fluid is supplied continuously to the injector 16 at a substantially constant pressure. Since the actuator is not cycled between an on position and an off position and the flow of starting fluid is not interrupted during cranking, the starting fluid is atomized at a relatively high pressure and a substantially constant rate. This is thought to result in improved atomization and distribution of the starting fluid in the engine.

When engine cranking is stopped the coil 56 is deenergized, and the force holding the cannister valve 40 in the open position is removed. The force of the spring 68 then acts in conjunction with the pressure exerted by the flowing starting fluid on the tip of the drive rod 58 and the upper surface of the armature 64 to move the armature 64 into the position shown in FIG. 2. Simultaneously, the valve 40 closes and a seal is formed between drive rod 58 and the stator 42.

Thus, the actuator 12 is moved to the position shown in FIG. 2 immediately following the termination of cranking. At this time a predetermined quantity of pressurized starting fluid is temporarily stored in the volume between the exit bore 52 and the seal 62. The major part of this volume is formed by the reservoir in the armature defined by the cavity 76. In alternate embodiments of the invention the cavity 76 can be eliminated and a shortened armature substituted for the armature 64 to form a reservoir. In such alternate embodiments the travel of the shortened armature in the tubular member 50 is preferably arrested to prevent the shortened armature from contacting the base of the tubular member 50 and thereby occupying the volume at the base of the tubular member. Starting fluid temporarily stored in the reservoir then moves under pressure to the injector 16, where it is atomized and injected into the engine during the period immediately following cranking. Starting fluid trapped between the armature 64 and the stator 42 flows through the annular volume 74 between the armature and the tubular member 50 to the exit bore 52 via the groove 72.

The size of the cavity 76 can be chosen to provide the desired quantity of starting fluid for post cranking injection. It has been discovered that for many diesel engines prompt engine startup is best achieved by injecting starting fluid throughout engine cranking and for a period of there to ten seconds thereafter. Of course, the duration of post cranking injection will vary with the pressure of the starting fluid, the size of the flow restricting orifice in the injector 16, the volume of the cavity 76, as well as the volume of the conduit 14 which interconnects the actuator 12 with the injector 16. One preferred embodiment of the invention suitable for use with an eight cylinder, 568 cubic inch displacement diesel engine utilizes a starting fluid pressure of approximately 100–150 pounds per square inch, a single injector orifice five-thousandths of an inch in diameter, a reservoir capacity of about two cubic centimeters in the actuator 12, and a conduit volume of about two and one-half cubic centimeters.

In this preferred embodiment it is the injector aperture which limits the flow of starting fluid into the engine. The injector 16 is supplied with starting fluid at high pressure, and the injector orifice is smaller than commonly used with measured shot dispensers of the prior art. This combination of high injector pressure and small aperture size is thought to result in more complete and more uniform atomization of the starting fluid in the air intake passage.

This preferred embodiment has been described as including a spring 68 placed between the armature 64 and the stator 42. This spring 68 serves the dual function of providing a restoring force which tends to return the armature 64 to the position shown in FIG. 2 as well as a damping force which reduces the vibration of the armature 64 when the coil 56 is de-energized. An alternate embodiment of the invention does not include a spring 68. It has been discovered that the fluid pressure of the starting fluid acting on the tip of the drive rod 58 is enough to return the drive rod to the sealed position of FIG. 2. Furthermore, by properly sizing the O-ring seal 62, a degree of damping can be achieved. Thus, it is possible to build the actuator 12 without the spring 68, thereby reducing production cost.

Though the valve actuator 12 has been shown as incorporating a cavity 76 which stores starting fluid for post cranking injection, it should be understood that the scope of the invention is broad enough to include a starting fluid storage reservoir positioned at any point between the cannister 10 and the injector 16. FIGS. 4*a*–4*d* depict external starting fluid reservoirs which can be used either in conjunction with or instead of the internal reservoir formed by the cavity 76 of FIG. 2.

FIG. 3 shows a detailed view of the injector 16 of FIG. 1. Because the flow passage defined in the injector 16 is small, the stored volume is also small. FIG. 4*a* shows a modified injector 16 which includes an elongated sleeve 78. The sleeve 78 defines a threaded portion 80 sized for connection with a coupling fitting on the conduit 14, and the internal volume 82 surrounded by the sleeve 78 forms a starting fluid reservoir.

FIG. 4*b* shows another alternate embodiment of the reservoir. In this case the reservoir is formed by a sleeve 84 provided with threaded connections 85,86 at each end, which are sized to mate with the threaded end section of the injector 16 and a coupling fitting on the conduit 14, respectively. Once again, the starting fluid reservoir is formed by the interior volume 88 of the sleeve 84. If desired, the sleeve 84 may be formed into an elbow reservoir to aid in mounting. Such an elbow reservoir is shown in FIG. 4*c*, where the elbow sleeve 98 is shown threaded at one end 100 for connection with the injector 16 and at the other end 102 for connection to a fitting which is in turn coupled to a coupling fitting on the conduit 14. Of course, the reservoir defining sleeves 84 and 98 are not limited to attachment to the injector 16, and may be sized for connection to the exit bore 52 of the valve actuator 12.

Yet another embodiment of the starting fluid reservoir is shown in FIG. 4*d*. This in-line reservoir is formed by a sleeve 94 which is threaded at each end for connection via fittings 90,92 to coupling fittings on the conduit 14. This reservoir can be placed at any convenient point in the conduit 14.

Each of these external reservoirs 82,88,104,96 can be sized to store the desired amount of starting fluid for post cranking injection. In some applications it may be desirable to use an external reservoir where the desired volume of post cranking starting fluid is larger than can be economically or conveniently stored inside the valve actuator 12. Another advantage of an external reservoir is that it permits the use of a single standardized valve actuator 12 for a number of different engines. The actuator 12 can be designed with a cavity 76 which forms a minimal reservoir suitable for most or even all of the engines on which the actuator will be used. Then the desired reservoir for any particular engine can be formed by combining a suitable external reservoir with the minimal reservoir of the actuator. Since the injector orifice size should preferably be matched to the engine, it will be convenient in many applications to combine an external reservoir with the injector.

Of course, it should be understood that various changes and modifications to the preferred embodiments described herein will be apparent to those skilled in the art. Such modifications can be made without departing from the spirit and scope of the present invention and without diminishing its attendant advantages. It is, therefore, intended that such changes and modifications be covered by the following claims.

I claim:

1. An apparatus for automatically injecting a pressurized starting fluid from a valved cannister into an air intake passage of an internal combustion engine provided with starter means, said apparatus comprising:

an injector mounted in the air intake passage to inject starting fluid into the passage;

an electrically activated valve actuator having an intake bore coupled to the valved cannister and an exit bore coupled to the injector, said valve actuator, when actuated, operating to continuously pass starting fluid from the valved cannister, through the intake and exit bores, to the injector;

reservoir means in fluid communication with the injector for temporarily storing a predetermined volume of starting fluid during the period when the valve actuator is activated, and for supplying said predetermined volume of starting fluid to the injector immediately following deactivation of the valve actuator;

means for automatically activating the valve actuator during operation of the starter means, such that the valve actuator is automatically controlled to cause starting fluid to be injected into the air intake passage during and immediately following operation of the starter means.

2. The apparatus of claim 1 wherein the reservoir means includes a cavity formed in the valve actuator.

3. The apparatus of claim 1, wherein the reservoir means includes a volume defining member mounted adjacent the valve actuator.

4. The apparatus of claim 1, wherein the reservoir means includes a volume defining member mounted adjacent the injector.

5. The apparatus of claim 1, wherein the reservoir means includes a cavity formed in the injector.

6. The apparatus of claim 1, further including a conduit interconnecting the valve actuator and the injector, wherein the reservoir means includes a volume formed in the conduit.

7. The apparatus of claim 6, wherein the reservoir means includes a volume defining member mounted in the conduit.

8. The apparatus of claim 1, 2, 3, 4, 5, 6, or 7, wherein the volume of the reservoir means is such that starting fluid is injected into the air intake passage for at least three seconds following deactivation of the valve actuator.

9. The apparatus of claim 1 wherein the activating means includes temperature responsive means for preventing activation of the valve actuator when engine temperature is greater than a predetermined level.

10. The apparatus of claim 2 wherein the valve actuator includes an electrical coil defining a central region, a movable armature disposed in the central region defined within the coil, and a drive rod positioned in the intake bore between the armature and the valved cannister, said coil, armature, and drive rod cooperating to actuate the cannister valve when electrical current is passed through the coil.

11. The apparatus of claim 10, wherein the exit bore of the valve actuator is in fluid communication with the central region and the reservoir means includes a cavity formed in the armature.

12. The apparatus of claim 10, wherein the exit bore of the valve actuator is in fluid communication with the central region and the reservoir means includes a cavity formed in the central region between the armature and the coil.

13. The apparatus of claim 10, wherein the valve actuator further includes means for creating a seal between the intake bore and the drive rod when the valve actuator is deactivated.

14. The apparatus of claim 10, wherein the drive rod is rigidly secured to the armature, the intake bore is defined by a stator, and a spring is provided between the armature and the stator to damp vibration of the armature.

15. An apparatus for injecting a pressurized starting fluid stored in a cannister having a valve into an air intake passage of an internal combustion engine provided with starter means, said apparatus comprising:

a stator adapted for connection to a portion of the cannister, said portion situated adjacent the cannister valve;

an intake bore defined in the stator and aligned with the cannister valve;

an electrical coil secured to the stator and defining a central volume;

an armature disposed in the central volume;

a drive rod positioned in the intake bore and the central volume between the armature and the cannister valve, said rod, armature, and coil cooperating to actuate the cannister valve when the coil is energized, thereby passing starter fluid from the cannister through the intake bore, into the central volume of the coil;

an exit bore adjacent the central volume of the coil;

a reservoir formed by a cavity in the armature in fluid communication with the exit bore, said reservoir adapted to temporarily store a predetermined volume of starting fluid during actuation of the cannister valve, and to supply this volume of starting fluid to the exit bore following deactuation of the cannister valve;

an injector mounted in the air intake passageway;

a conduit interconnecting the exit bore and the injector; and electrical means connected to the coil and responsive to the starter means for energizing the coil during operation of the starter means, thereby ensuring continuous actuation of the cannister valve and injection of starting fluid into the air intake passage throughout operation of the starter means, said electrical means further including thermostat means for preventing the coil from being energized when engine temperature is above a preselected value.

16. The apparatus of claim 15, wherein a groove is formed in the drive rod and an O-ring seal is provided in the intake bore between the stator and the drive rod, said O-ring seal operating to form a seal between the stator and the drive rod when the coil is de-energized, said groove adapted to prevent said O-ring seal from contacting the drive rod when the coil is energized and the cannister valve is actuated.

17. The apparatus of claim 16, wherein the pressurized starting fluid acts on the drive rod and the armature to provide the principal closing force acting to move the drive rod into a sealing relationship against the O-ring seal after the coil is deenergized.

18. The apparatus of claim 16, further including a spring disposed in the central volume between the stator and the armature to dampen movement of the armature.

19. An apparatus for injecting a pressurized starting fluid stored in a cannister having a valve into an air intake passage of an internal combustion engine provided with starter means, said apparatus comprising:

a stator adapted for connection to a portion of the cannister, said portion situated adjacent the cannister valve;

an intake bore defined in the stator and aligned with the cannister valve;

an electrical coil secured to the stator and defining a central volume;

a tubular member disposed in the central volume;

an armature disposed in the tubular member having a length less than that of the tubular member;

a drive rod positioned in the intake bore and the central volume between the armature and the cannister valve, said rod, armature, and coil cooperating to actuate the cannister valve when the coil is energized, thereby passing starter fluid from the cannister through the intake bore, into the central volume of the coil;

an exit bore adjacent the central volume of the coil;

a reservoir formed between the tubular member and the armature in fluid communication with the exit bore, said reservoir adapted to temporarily store a predetermined volume of starting fluid during actuation of the cannister valve, and to supply this volume of starting fluid to the exit bore following deactuation of the cannister valve;

an injector mounted in the air intake passageway;

a conduit interconnecting the exit bore and the injector; and electrical means connected to the coil and responsive to the starter means for energizing the coil during operation of the starter means, thereby ensuring continuous actuation of the cannister valve and injection of starting fluid into the air intake passage throughout operation of the starter means, said electrical means further including thermostat means for preventing the coil from being energized when engine temperature is above a preselected value.

* * * * *

UNITED STATES PATENT AND TRADEMARK OFFICE

CERTIFICATE OF CORRECTION

PATENT NO. : 4,202,309

DATED : May 13, 1980

INVENTOR(S) : James W. Burke

It is certified that error appears in the above-identified patent and that said Letters Patent are hereby corrected as shown below:

Column 5, line 22, delete "there" and insert therefor --three--.

Signed and Sealed this

*Twenty-third* Day of *September 19*

[SEAL]

*Attest:*

SIDNEY A. DIAMOND

*Attesting Officer*

*Commissioner of Patents and Tradema*